US005234135A

United States Patent [19]

LaFosse et al.

[11] Patent Number: 5,234,135

[45] Date of Patent: Aug. 10, 1993

[54] DEVICE FOR SPRAYING OR DISPENSING FLUID PRODUCT IN WHICH PRODUCT CONTAINED IN THE OUTLET PASSAGE IS ASPIRATED AT THE END OF ACTUATION

[75] Inventors: Alain LaFosse, Le Neubourg; Firmin Garcia, Evreux; Jean-Pierre Lina, Le Neubourg, all of France

[73] Assignee: Valois (Société Anonyme), Le Neubourg, France

[21] Appl. No.: 791,127

[22] Filed: Nov. 13, 1991

[30] Foreign Application Priority Data

Nov. 13, 1990 [FR] France ..... 9014028

[51] Int. Cl.[5] ..... B05B 11/00

[52] U.S. Cl. ..... 222/321; 222/375

[58] Field of Search ..... 222/321, 383, 385, 341, 222/378, 380; 239/333

[56] References Cited

U.S. PATENT DOCUMENTS

| | | | |
|---|---|---|---|
| 4,017,031 | 4/1977 | Kishi et al. | 222/321 X |
| 4,434,916 | 5/1984 | Ruscitti et al. | 222/321 |
| 4,640,443 | 2/1987 | Corsette | 222/375 X |
| 5,011,046 | 4/1991 | Graf et al. | 222/321 |
| 5,092,495 | 3/1992 | Andre | 222/321 X |
| 5,096,097 | 3/1992 | Lina | 222/321 X |

FOREIGN PATENT DOCUMENTS

| | | |
|---|---|---|
| 377536 | 7/1990 | European Pat. Off. . |
| 2165571 | 8/1973 | France . |
| 2643338 | 8/1990 | France . |
| 2091818 | 8/1982 | United Kingdom . |

*Primary Examiner*—Andres Kashnikow
*Assistant Examiner*—Kenneth DeRosa
*Attorney, Agent, or Firm*—Sughrue, Mion, Zinn, Macpeak & Seas

[57] ABSTRACT

A pump for dispensing or spraying a fluid product comprises a pump body delimiting a pump chamber in which slides a piston. The pump comprises a hollow plunger-rod having an outlet passage. The plunger-rod is coupled to the piston to actuate the piston and to enable escape of the product. The pump further comprises an aspiration chamber which communicates with the hollow plunger-rod and which is reduced in volume when the plunger-rod is depressed and increased in volume when pressure is removed from the plunger-rod. The aspiration chamber is delimited by the piston and the plunger-rod and the volume of the chamber is varied by relative sliding movement between the plunger-rod and the piston.

12 Claims, 13 Drawing Sheets

DEVICE FOR SPRAYING OR DISPENSING FLUID PRODUCT IN WHICH PRODUCT CONTAINED IN THE OUTLET PASSAGE IS ASPIRATED AT THE END OF ACTUATION

BACKGROUND OF THE INVENTION

1. Field of the Invention

The present invention concerns a device for spraying or dispensing fluid product in which product contained in the outlet passage is aspirated at the end of actuation.

2. Description of the Prior Art

Many fluid products are packaged in pump or valve dispensers which spray the product or dispense it without spraying it when a user presses a plunger. The product is discharged through an outlet passage usually incorporated in the plunger.

At the end of discharge of the product a certain quantity of product remains in the outlet passage. If the end part of the outlet passage is horizontal the product contained in this part of the outlet passage can then leak out of the passage in periods when the device is not used. In the case of a product that is not very volatile, such as a paste or a cream, the product escaping in this way from the outlet passage does not evaporate but runs or drips onto the bottle in which the product is stored or its surroundings, soiling said bottle or said surroundings.

Also, the end part of said outlet passage is usually of small diameter with the result that some of the product remaining in this end part for a long period of non-use can dry and block said end part.

An object of the present invention is to avoid these drawbacks.

SUMMARY OF THE INVENTION

The present invention consists in a pump for dispensing or spraying a fluid product comprising a pump body delimiting a pump chamber in which slides a piston, said pump comprising a hollow plunger-rod having an outlet passage, said plunger-rod being coupled to the piston to actuate said piston and to enable escape of the product, said pump further comprising an aspiration chamber which communicates with the hollow plunger-rod and which is reduced in volume when the plunger-rod is depressed and increased in volume when pressure is removed from the plunger-rod, wherein said aspiration chamber is delimited by the piston and the plunger-rod and the volume of said chamber is varied by relative sliding movement between the plunger-rod and the piston.

In one embodiment of the invention, the plunger-tube comprises a ring extended towards the pump chamber by a skirt inside which slides an upper annular part of the piston in fluid-tight contact with said skirt and said plunger-tube further comprises a solid cylindrical part on which a lower tubular part of the piston can slide to cut off communication between the pump chamber and the outlet passage, said pump chamber communicating with said outlet passage when said lower tubular part of the piston is above said solid cylindrical part of the plunger-rod.

Alternatively, an upper annular part of the piston slides in fluid-tight contact with a complementary part of the plunger-rod and said plunger-rod further comprises a solid cylindrical part on which a lower tubular part of the piston can slide to interrupt communication between the pump chamber and the outlet passage, said pump chamber communicating with said outlet passage when said lower tubular part of said piston is above said solid cylindrical part of the plunger-rod.

In another embodiment of the invention, the plunger-rod comprises a reduced cross-section lower part having a lateral orifice communicating with the outlet passage and the passage has an interior tubular part sliding in fluid-tight contact with the plunger-rod, said interior tubular part being extended by a reduced cross-section lower end sliding in fluid-tight contact with the reduced cross-section lower part of the plunger-rod, said aspiration chamber being delimited by the plunger-rod, its reduced cross-section lower part, the interior part of the piston and its reduced cross-section lower end. The reduced cross-section lower part of the plunger-rod comprises at least one groove extending in the axial direction from the lateral orifice away from the pump chamber. A first spring disposed in the pump chamber urges the piston towards the exterior of the pump and a second spring mounted between the plunger-rod and the piston urges the plunger-rod away from the piston towards the exterior of the pump.

Other features and advantages of the invention will emerge from the following detailed description of various embodiments of the invention given by way of non-limiting example with reference to the appended drawings.

FIG. *7a* is a view in axial cross-section of an alternative version of the pump from FIG. 7.

FIG. *7b* is a view in axial cross-section of an alternative version of the pump from FIG. 7.

Figure 7A:
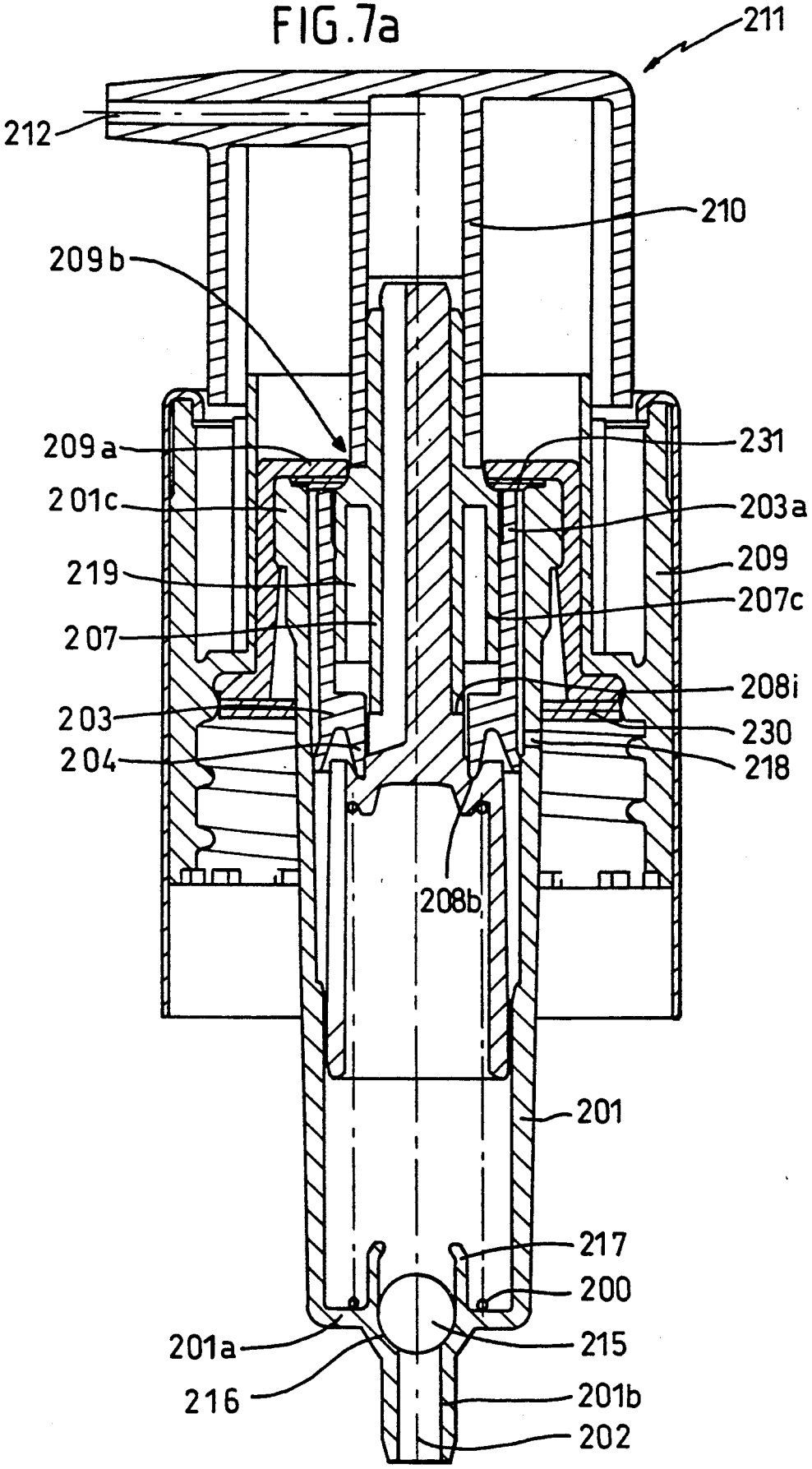
FIG. 7 is a view in axial cross-section of a metering pump in a third embodiment of the invention.
Figure 7B:
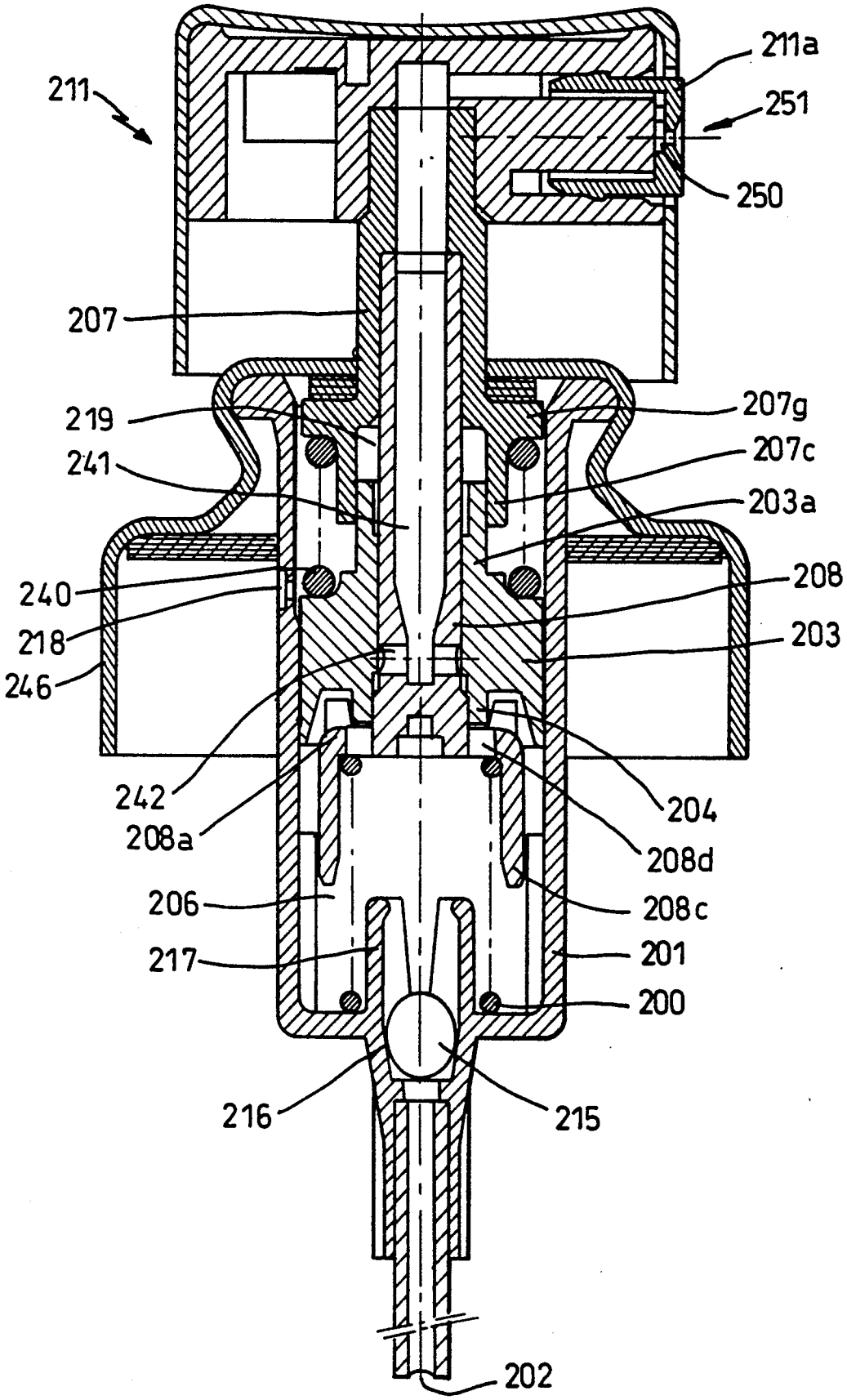
Figure 8:
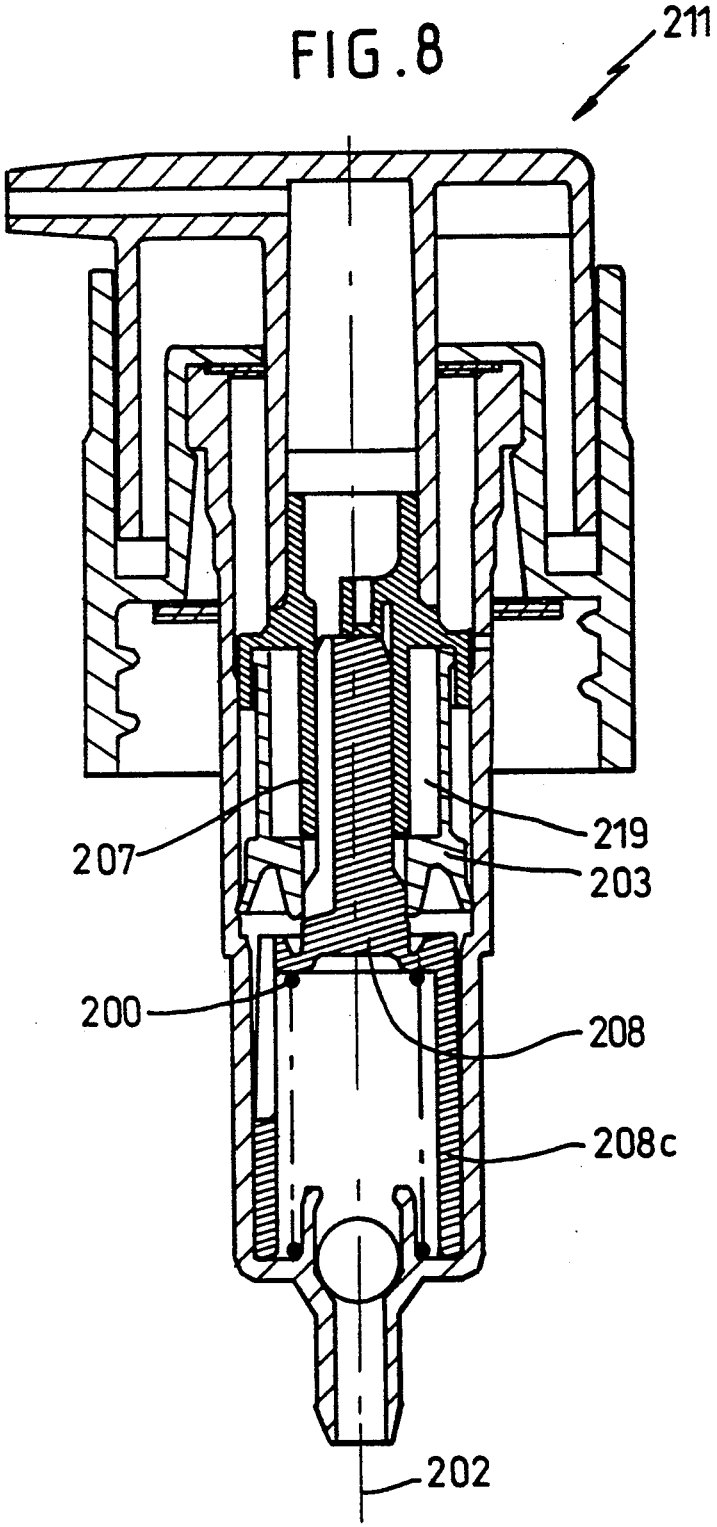

FIG. 8 is a view in axial cross-section of the pump from FIG. 7 shown in the operated position.

Figure 9:
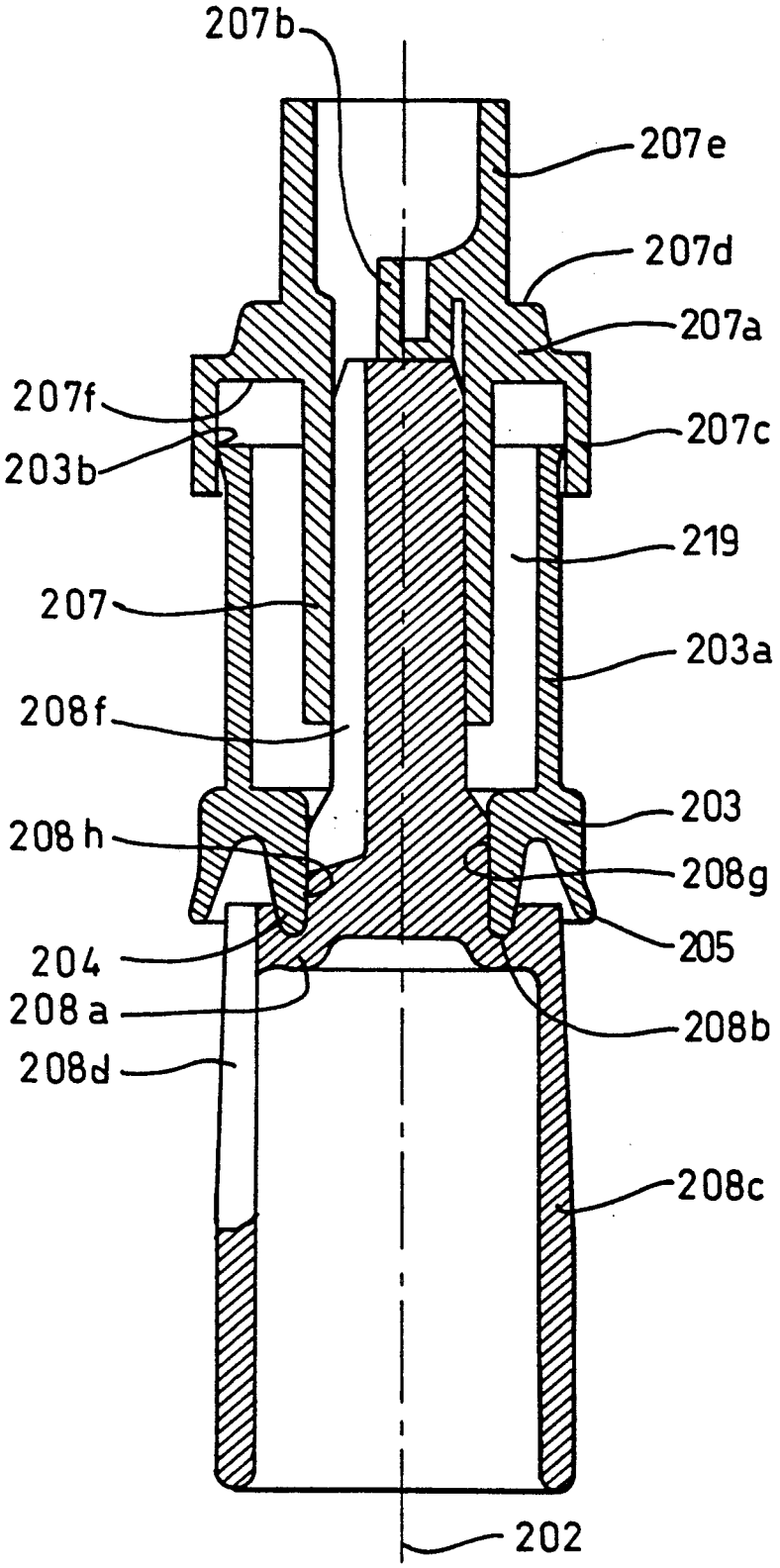

FIG. 9 is a detail view of part of the pump from FIG. 7.

Figure 10:
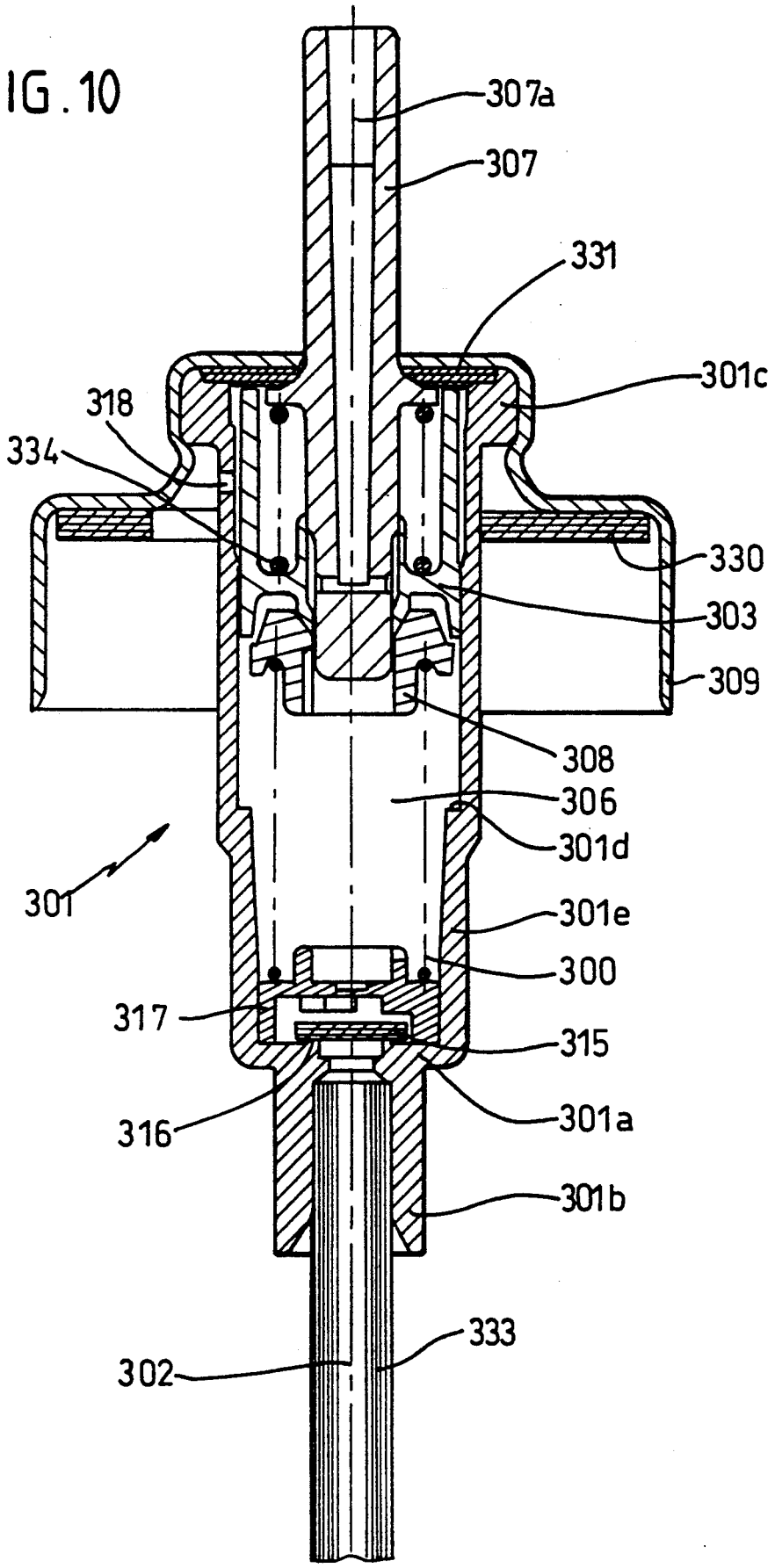

FIG. 10 is a view in axial cross-section of a metering pump in a fourth embodiment of the invention.

Figure 11:
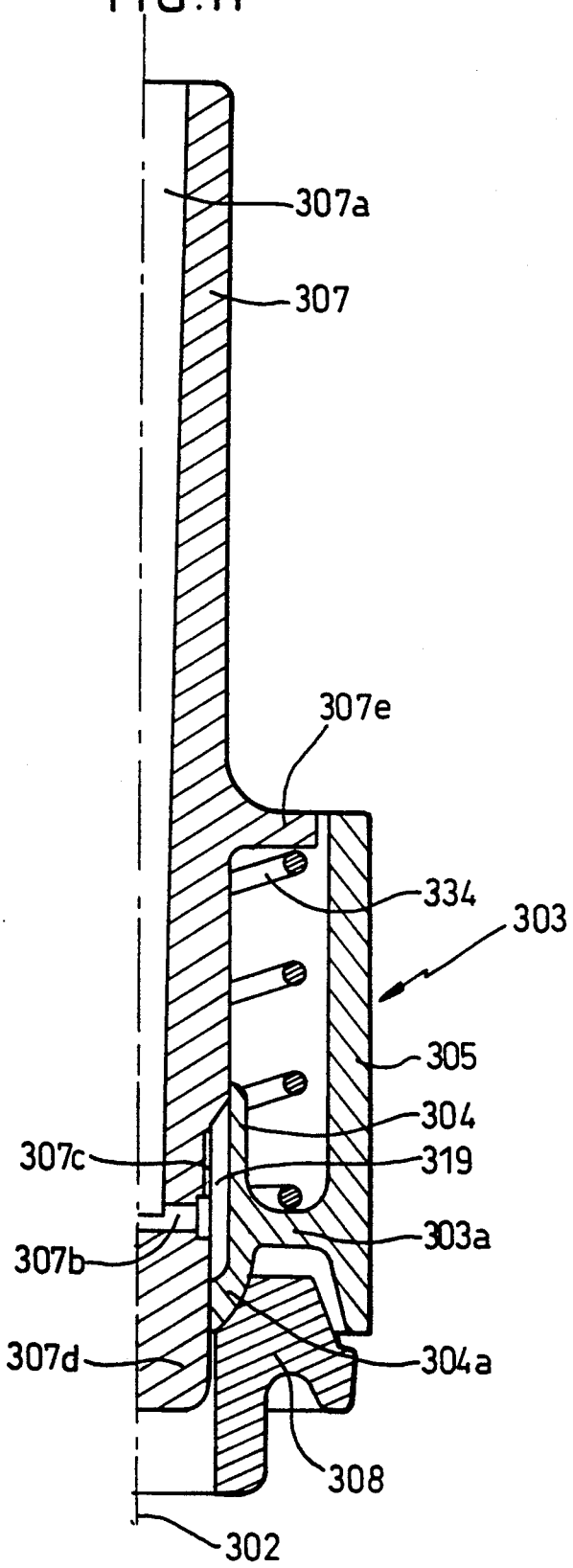

FIG. 11 is a detail view of part of the pump from FIG. 10 shown in the unoperated position.

Figure 12:
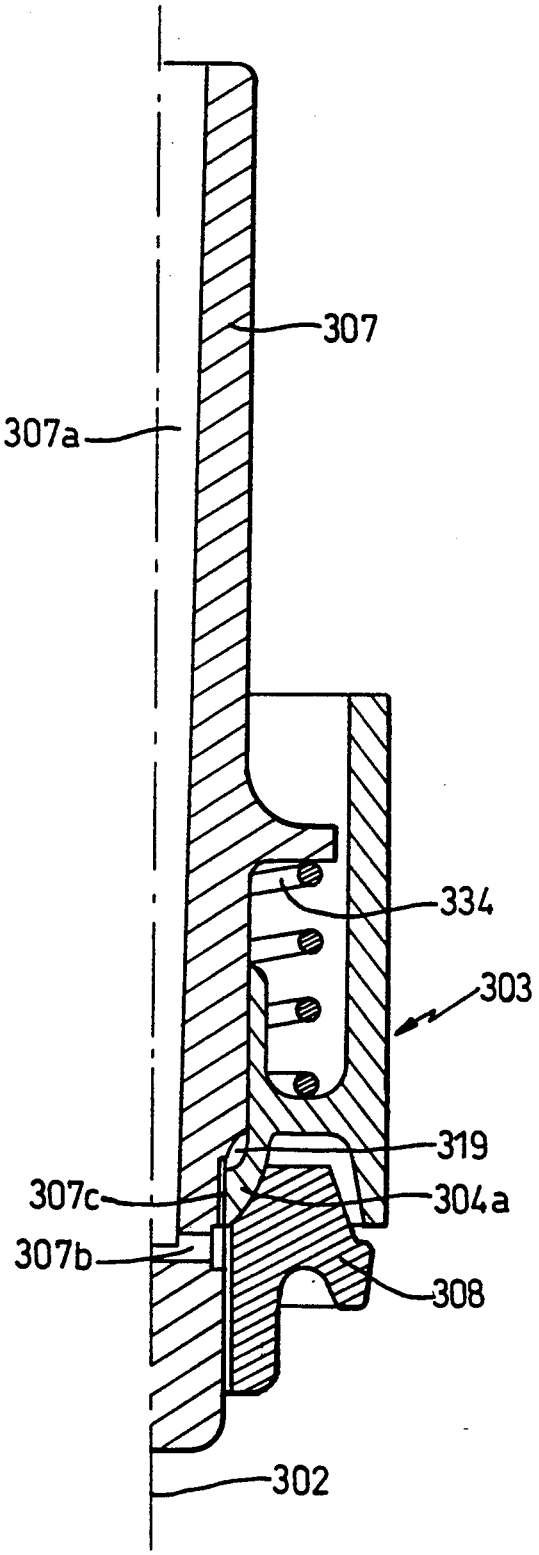

FIG. 12 is a view of the same parts as FIG. 11 but during dispensing or spraying of the product.

DETAILED DESCRIPTION OF THE INVENTION

First embodiment

Figure 1:
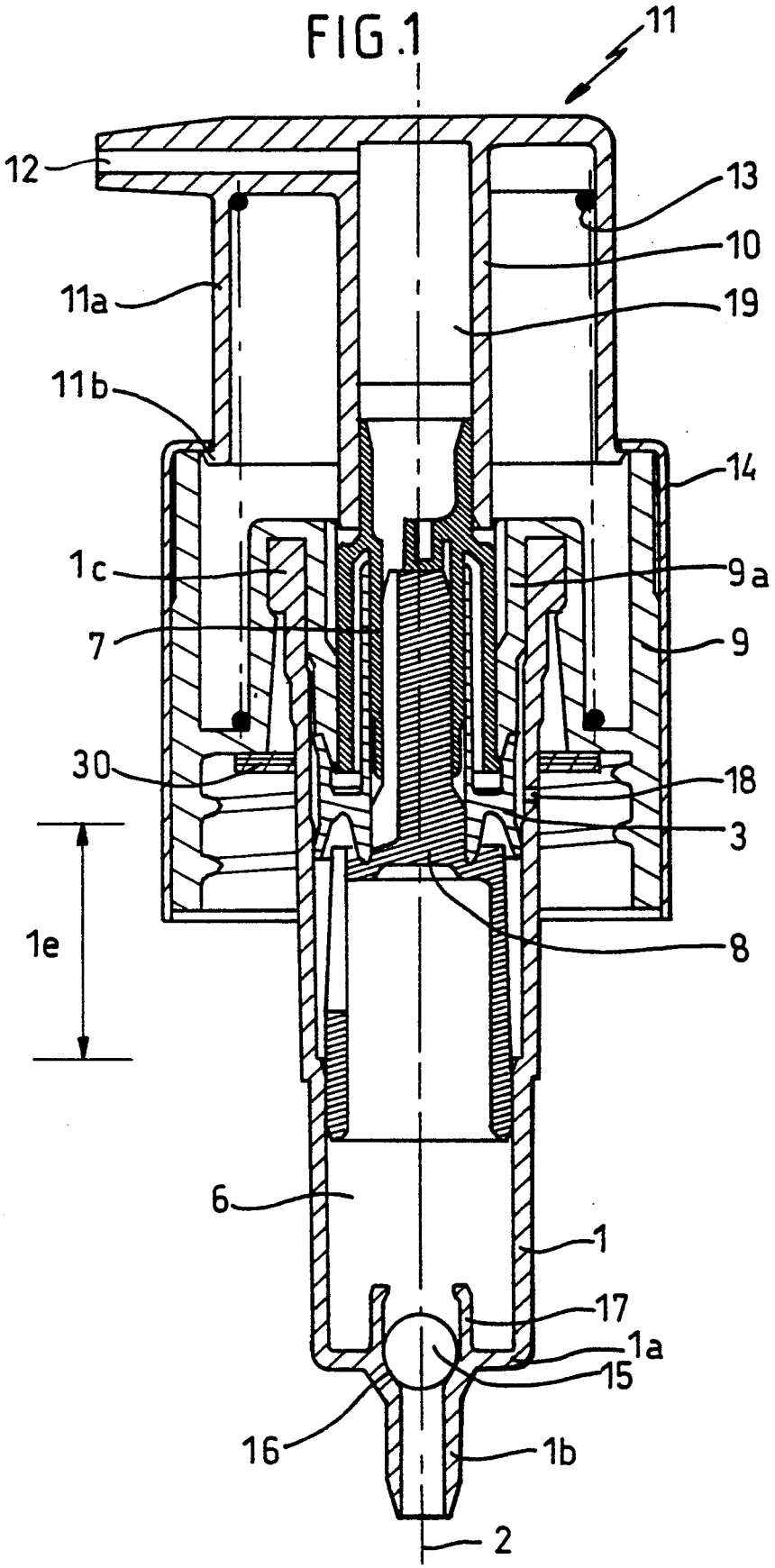
FIG. 1 is a view in axial cross-section of a metering pump in a first embodiment of the invention, shown in the unoperated position.

FIG. 1 shows a metering pump in a first embodiment of the invention. The pump comprises a hollow cylindrical pump body 1 having an axis of revolution 2 and delimiting a pump chamber 6 which normally contains a fluid product to be dispensed. The pump body 1 comprises an open upper end 1c and a reduced cross-section lower end 1a extended downwardly by an inlet tube 1b. The inlet tube 1b communicates with a reservoir of product to be dispensed (not shown), directly or through the intermediary of a down-tube (not shown). The inlet tube 1b is provided with an inlet valve which opens when the pressure in the pump chamber 6 is reduced and closes when the pressure in said pump chamber 6 is increased. The inlet valve may be of any known form. For example, it may consist of a ball 15 that can be applied in a fluid-tight way to a valve seat 16 to close the inlet tube 1b when the pressure in the pump chamber 6 is increased and a plurality of arms 17 extending above the valve seat 16 which hold the ball 15 near the valve seat 16 when said ball 15 is raised off said valve seat 16 by reduction of the pressure in the pump chamber 6.

The pump body 1 may be snap-fastened to a cap 9 screwed to the neck of the product reservoir (not shown), for example. An annular gasket 30 may be disposed between the cap 9 and the neck of the reservoir. However, the pump body 1 could be fixed to the reservoir by any other known means without departing from the scope of the present invention.

In the specific embodiment shown in FIG. 1 the cap 9 has an inner ring 9a which extends a certain distance vertically down the inside perimeter of the pump body 1 from the open upper end 1c of said pump body.

Figure 3:
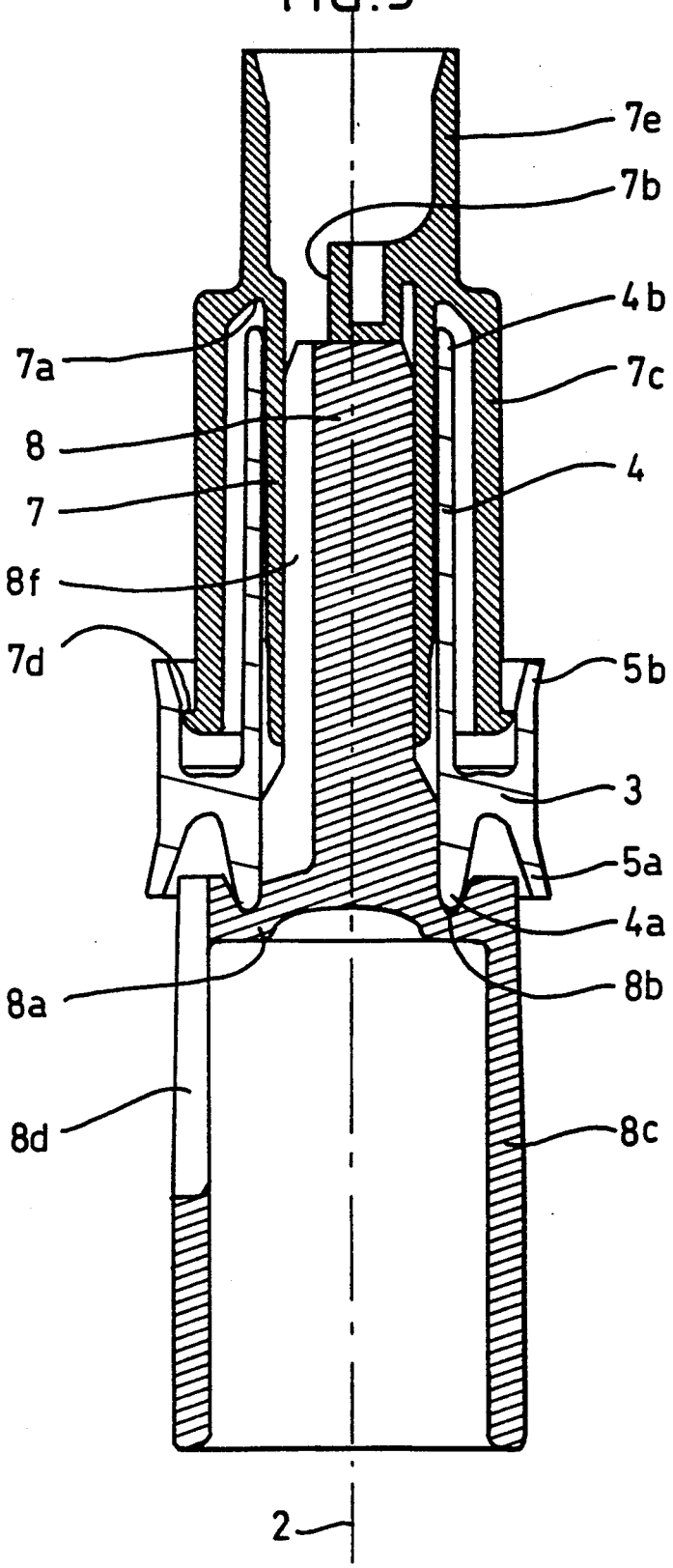
FIG. 3 is a detail view showing part of the pump from FIG. 1.

A piston 3 slides in the pump body 1. As shown in FIG. 3, the piston 3 is a body of revolution about the axis 2 and comprises a tubular central part 4 extending between a lower end 4a and an upper end 4b. The piston 3 further comprises two peripheral outer lips 5a and 5b at its lower and upper ends, respectively, adapted to provide a seal between the pump body 1 and the piston 3 at least when said sealing lips 5a and 5b are in a part 1c of the pump body.

Referring to FIG. 3, the piston 3 slides with lost motion on a plunger rod 7, 8 consisting of a sleeve 7 force-fitted onto an inner core 8 so that the sleeve 7 and the inner core 8 are fastened together. The piston 3 slides on the sleeve 7 and the contact between the piston and the sleeve is fluid-tight. The sleeve 7 comprises at least one ring 7a forming an upper abutment for the upper end 4b of the tubular central part 4 of the piston. The inner core comprises an enlarged lower part 8a having a peripheral seat 8b forming a bottom abutment for the lower end 4a of the tubular central part 4 of the piston to which said lower end 4a can be applied in a fluid-tight manner.

The inner core 8 further has at lest one longitudinal groove 8f at its perimeter through which the pump chamber 6 communicates with the outside when said lower end 4a of the tubular central part 4 of the piston is not applied in a fluid-tight manner to the peripheral seat 8b of the inner core 8.

In the specific embodiment shown in FIG. 3 the enlarged lower end 8a of the inner core 8 is extended downwardly by a skirt 8c sliding in the pump body 1 which in particular contributes to guiding the plunger-rod 7, 8 and the piston in the pump body 1. The skirt 8c also serves to limit downward movement of the plunger-rod when it abuts the reduced cross-section lower end 1a of the pump body 1. Additionally, the skirt 8c comprises one or more openings 8d enabling communication between the pump chamber 6 and the groove 8c when the lower end 4a is not in fluid-tight contact with the peripheral seat 8b.

As an alternative, it would be possible to substitute for the skirt 8c vertical arms of the same height distributed around the perimeter of the increased cross-section lower end 8a of the core 8. The skirt 8c can even by totally dispensed with if the moving parts of the pump can be adequately guided by other means.

In the specific embodiment shown in FIG. 3 the sleeve 7 has on its interior a relief 7b enabling precise relative positioning of the sleeve 7 and the inner core 8: to assemble them together, these two parts are nested one inside the other with the piston 3 trapped between them and pushed towards each other until the interior relief 7b of the sleeve 7 abuts the inner core 8.

The sleeve 7 further comprises an exterior skirt 7c extending from the ring 7a towards the pump chamber 6 and surrounding the tubular part 4 of the piston. It slides inside the inner ring 9a of the cap 9, so contributing to the guiding of the plunger-rod 7, 8 in the pump body 1. The height of the exterior skirt 7c of the sleeve 7 is advantageously such that it abuts the piston 3 when the upper end 4b of the tubular central part 4 of the piston abuts the ring 7a of the sleeve. The exterior skirt 7c may comprise an exterior flange 7d in its lower part which contributes to the guiding of the piston 3 with respect to the plunger-rod 7, 8.

As an alternative, the exterior skirt 7c could be replaced by a plurality of arms the same height as the skirt 7c each comprising on its outside a peg replacing the exterior flange 7d of the ring.

Finally, the sleeve 7 comprises a tubular upper part 7e which fits within an axial tube 10 which is a body of revolution about the axis 2 of a plunger 11 (see FIG. 1). The tubular upper part 7e of the sleeve 7 and the axial tube 10 of the plunger 11 therefore delimit a chamber 19 referred to hereinafter as the aspiration chamber. The upper tubular part 7e can slide within the axial tube 10 with considerable friction. The axial tube 10 communicates with an outlet passage 12, a horizontal passage, for example, which discharges laterally from the plunger 11. The plunger 11 can have any known shape. It may comprise a spray nozzle.

A spring 13 bears on the plunger 11 and on the cap 9 so as to urge the plunger 11 upwards. To limit the upward movement of the plunger 11 the latter has a skirt 11a comprising in its lower part an exterior flange 11b which abuts a metal cup 14 crimped around the cap 9. The exterior flange 11b could be replaced with outwardly directed pegs.

The pump as previously described operates as follows:

1. When a user presses on the plunger 11, compressing the spring 13, the upper tubular part 7e of the sleeve 7 initially remains fixed relative to the axial tube 10 of the plunger 11 because of the high friction between said tubular part 7e and said axial tube 10. The combination of the sleeve 7 and the inner core 8 is therefore driven downwards by the plunger 11 which also moves the piston 3 downwards because of friction between said piston and the sleeve 7. This downward movement tends to reduce the volume of the pump chamber 6 and therefore increases the pressure in it which closes the inlet valve 15, 16, 17. The pump chamber 6 is then isolated: as the product contained in said pump chamber 6 is incompressible, the piston 3 remains immobile whereas the plunger-rod 6, 7 moves down into the pump body. During this movement the piston 3 therefore slides on the sleeve 7 and the inner core 8 until the upper end 4b of the tubular central part 4 of the piston abuts the ring 7*a* of the sleeve. The lower end 4*a* of the tubular central part of the piston is therefore lifted off the peripheral seat 8*b* to establish communication between the pump chamber 6 and the longitudinal groove 8*f* of the central core 8.

As soon as the upper end 4*b* of the tubular central part 4 of the piston abuts the ring 7*a* the piston 3 is in turn moved downwards.

As the piston moves down in the pump chamber 6 the product contained in it is ejected through the groove 8*f* of the inner core 8, the vertical tube 10 of the plunger and the lateral passage 12 of the plunger.

Figure 2:
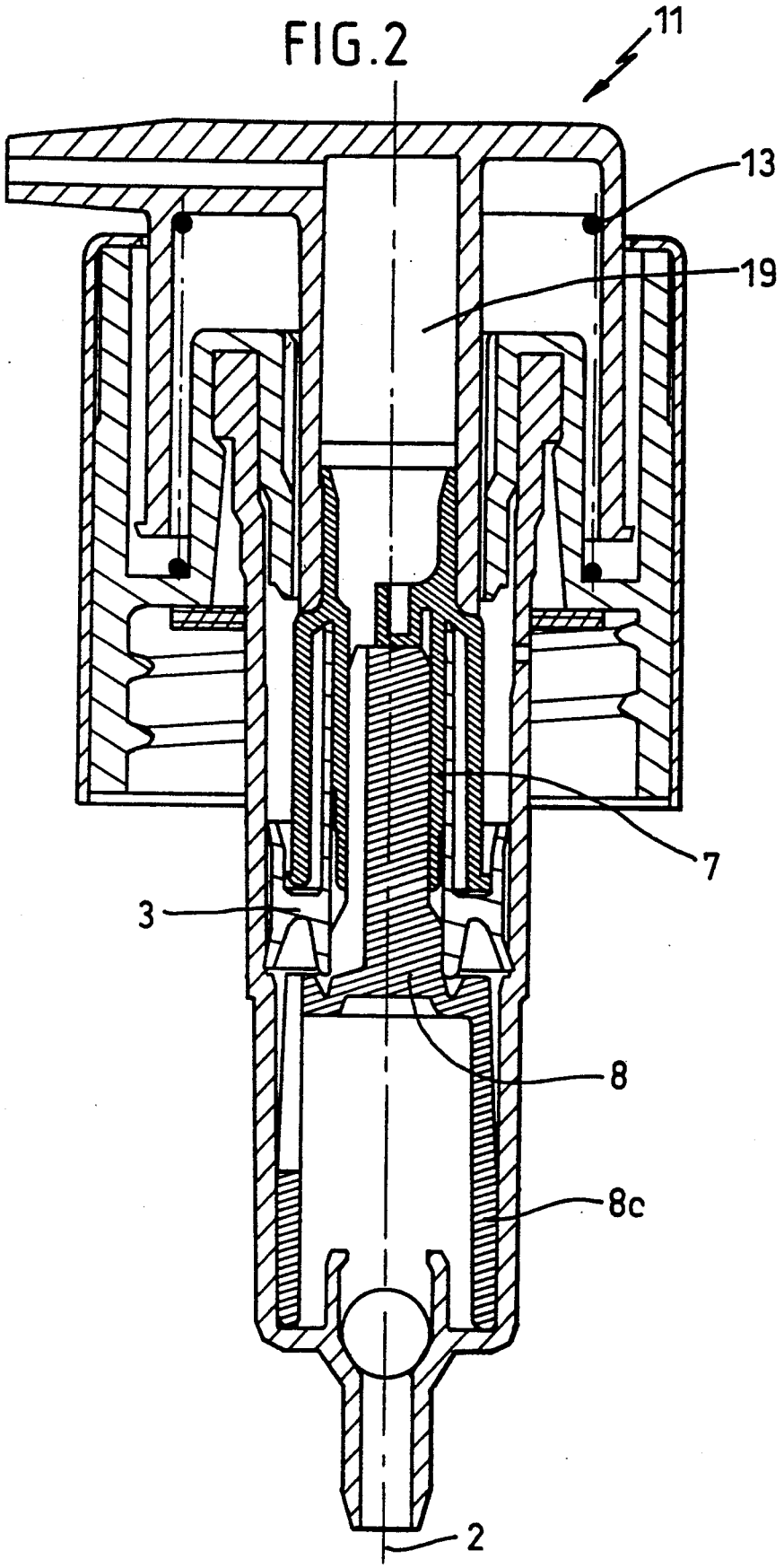
FIG. 2 is a view in axial cross-section of the pump from FIG. 1 shown in the operated position.

When the skirt 8*c* abuts the reduced cross-section lower end 1*a* of the pump body the downward movement of the plunger-rod 7, 8 and the piston 3 stops: because of the force exerted by the user on the plunger 11, the axial tube 10 slides downwards parallel to the axis 2 along the tubular upper part 7*e* of the sleeve 7, as shown in FIG. 2. This sliding movement reduces the interior volume of the aspiration chamber 19.

2. When the user releases the plunger 11 it is pushed up by the spring 13. Because of said high friction between the vertical tube 10 of the plunger and the upper tubular part 7*e* of the sleeve 7, said sleeve 7 first remains fixed relative to the plunger 11: the plunger-rod 7, 8 is therefore drawn upwards by the plunger 11.

Initially the piston 3 remains immobile because of the friction between said piston 3 and the pump body 1, during the upward movement of the plunger-rod 7, 8, until the lower end 4*a* of the tubular central part 4 of the piston comes into contact with the peripheral seat 8*b* of the inner core 8, cutting off communication between the pump chamber 6 and the groove 8*f* of the inner core 8. This isolates the pump chamber 6.

Because it is in contact with the peripheral seat 8*b*, the piston 3 is then drawn upwards by the plunger-rod 7, 8. The volume of the pump chamber 6 therefore increases, which reduces the pressure in it, which opens the inlet valve 15, 16, 17 and enables the fluid product contained in the reservoir to enter the pump chamber 6 as the piston 3 rises.

When the upper lip 5*b* of the piston 3 comes into contact with the inner ring 9*a* of the cap 9 this upward movement halts.

The plunger 11 then continues to rise on its own due to the action of the spring 13; it slides upwards, parallel to the axis 2, along the upper tubular part 7*e* of the sleeve 7. The effect of this is to increase the volume of the aspiration chamber 19. As the aspiration chamber 19 is isolated from the pump chamber 6 by the contact between the upper end 4*a* and the peripheral seat 8*b*, this increase in volume creates suction in the outlet passage 12: the product in said outlet passage 12 is therefore aspirated into the aspiration chamber 19. The increase in the volume of the aspiration chamber 19 is preferably such that after this aspiration the level of the product in the vertical tube 10 is below the outlet passage 12, so that outlet passage 12 contains no more product.

In the example shown in FIGS. 1 and 2 the pump body 1 comprises a familiar air inlet orifice 18 at the side, to enable air to enter the product reservoir as the product that it contains is consumed by the pump. It is obvious that this orifice 18 could be dispensed with, so that the pump operates without ingress of air, without departing from the scope of the present invention.

Similarly, the pump shown does not comprise any internal spring to push the actuator assembly 7, 8 and the piston upwards, as the return to the raised position is effected by the spring 13, whose upward thrust is transmitted to the assembly 7, 8 by the friction-fit of the vertical tube 10 of the plunger onto the upper tubular part 7*e* of the sleeve 7. Thus one advantage of this device is that it does not comprise any spring or any other metal part in contact with the product to be dispensed: this can avoid pollution of the product by substances contained in the steel of the spring or by oxidation of the spring.

However, it goes without saying that, without departing from the scope of the present invention, a spring could be provided in the pump chamber 6, in addition to the exterior spring 13, to facilitate the upward movement of the plunger-rod 7, 8.

Figure 4:
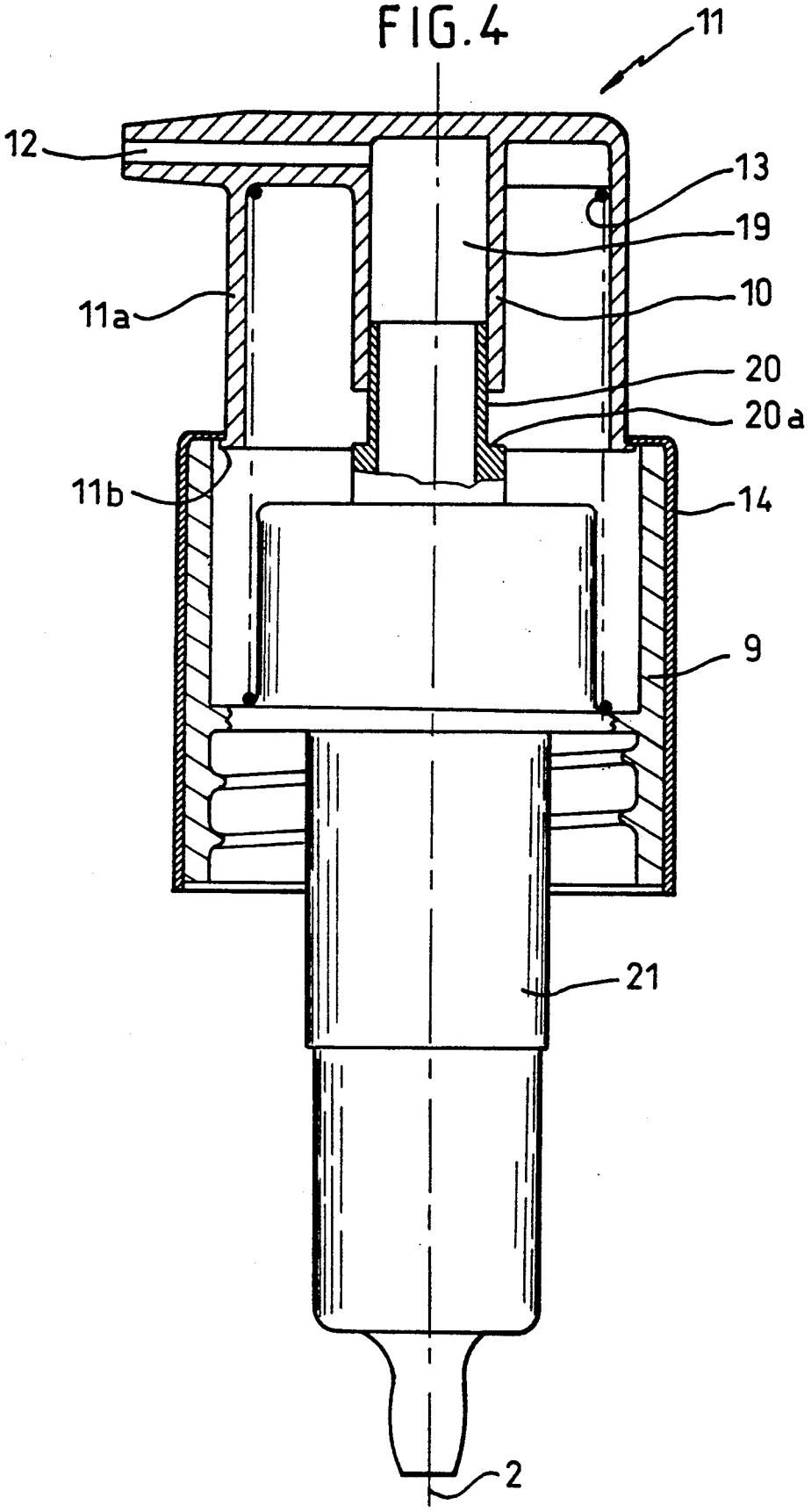
FIG. 4 is a view in partial cross-section of a dispensing or spraying device in a first embodiment of the invention.

It is also necessary to point out that this first embodiment of the invention can be applied to any type of metering pump or valve for dispensing or spraying the product under gas pressure, as shown in FIG. 4. These dispensing or spraying devices 21 always have a hollow plunger-rod 20 with an axis of symmetry 2 onto which can be sleeved an axial tube 10 of a plunger 11 which in this example discharges laterally to the outside of the plunger 11 through an outlet passage 12, a horizontal passage, for example. It goes without saying that the plunger 11 could have any other shape without departing from the scope of the present invention.

The hollow plunger-rod 20 enables the product to escape when it is depressed. The axial tube 10 of the plunger 11 is mounted to slide on the plunger-rod 20: the axial tube 10 and the plunger-rod 20 therefore delimit an aspiration chamber 19. The travel of the plunger 11 relative to the plunger-rod 20 in the downward direction is limited by a lower abutment on the rod 20, for example an exterior shoulder 20*a* on the rod 20. Also, the plunger 11 is urged upwards by a spring 13 bearing on the plunger 11 and directly or indirectly on the spraying or dispensing device 21.

In FIG. 4 the spring 13 bears indirectly on the device 21 through the intermediary of a cap 9 into which the device 21 is snap-fastened and which can be screwed onto the neck of a product reservoir (not shown): it goes without saying that the device 21 could be mounted on the product reservoir in a different way without departing from the scope of the present invention.

The upward travel of the plunger 11 is limited by any known means: for example, as shown in FIG. 4, the plunger 11 has a skirt 11*a* comprising an exterior flange 11*b* at its lower end, or possibly exterior pegs instead of the flange, which abuts a metal cup 14 crimped around the cap 9 and therefore fastened to the spraying or dispensing device 21.

When a user depresses the plunger 11 the plunger-rod 20 is depressed to discharge the product and during this movement the axial tube 10 of the plunger is pushed all the way down onto the plunger-rod 20 until it abuts the exterior shoulder 20*a* of said plunger-rod 20: this reduces the interior volume of the aspiration chamber 19. When the user releases the plunger 11, the latter is pushed upwards by the spring 13. The plunger-rod 20 is moved to a raised position either by the action of spring means internal to the device 21 or by the action of the spring 13 transmitted to said plunger-rod 20 by friction between the axial tube 10 and said plunger-rod 20. During this movement the plunger 11 moves upwards relative to the plunger-rod 20 by virtue of sliding of the axial tube 10 on said plunger-rod 20, the effect of which is to increase the interior volume of the aspiration chamber 19 and cause suction in the outlet passage 12, aspirating the product contained in said outlet passage 12 towards the aspiration chamber 19.

Second embodiment

Figure 5:
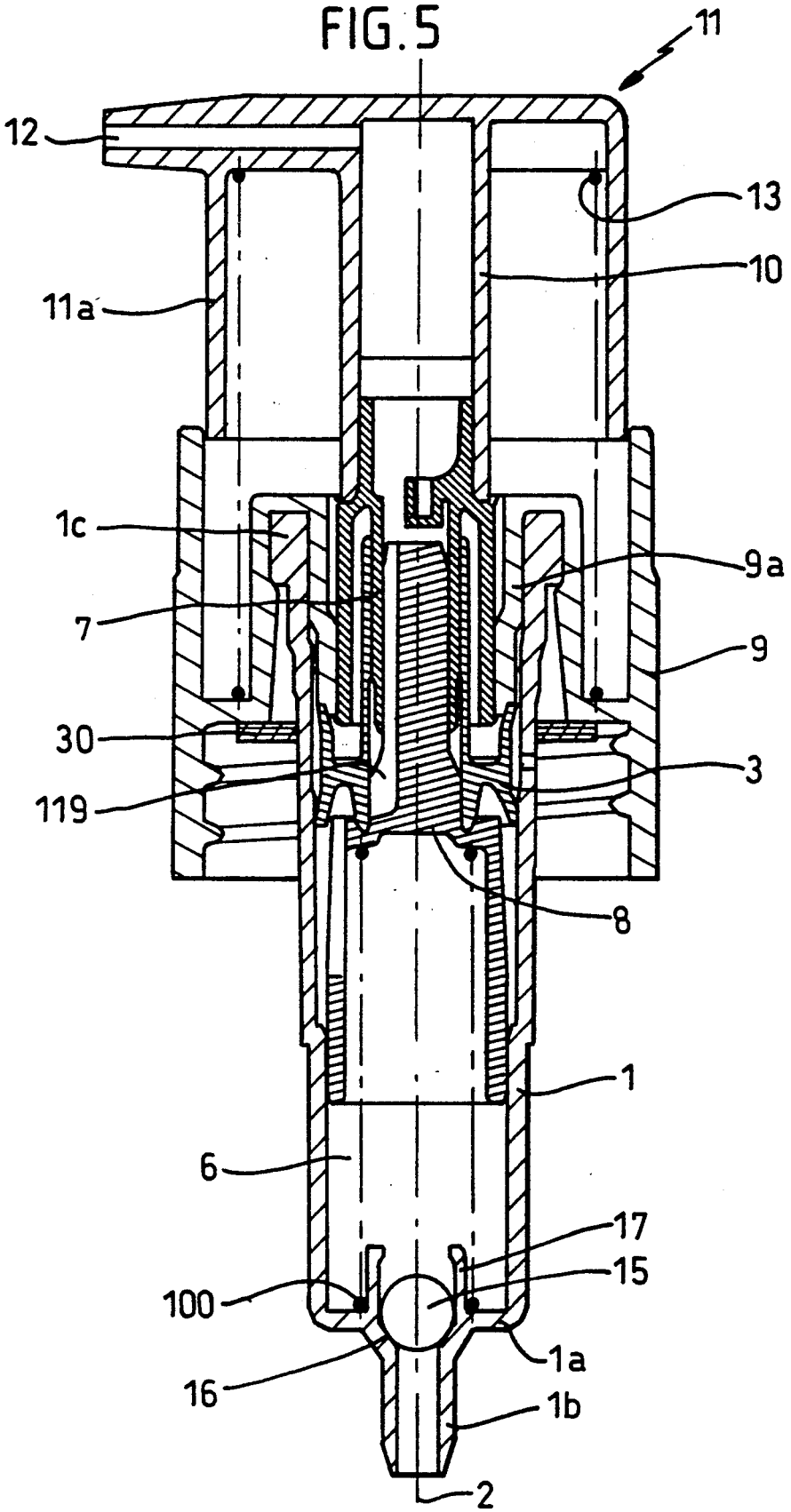
FIG. 5 is a view in axial cross-section of a metering pump in a second embodiment of the invention.
Figure 6:
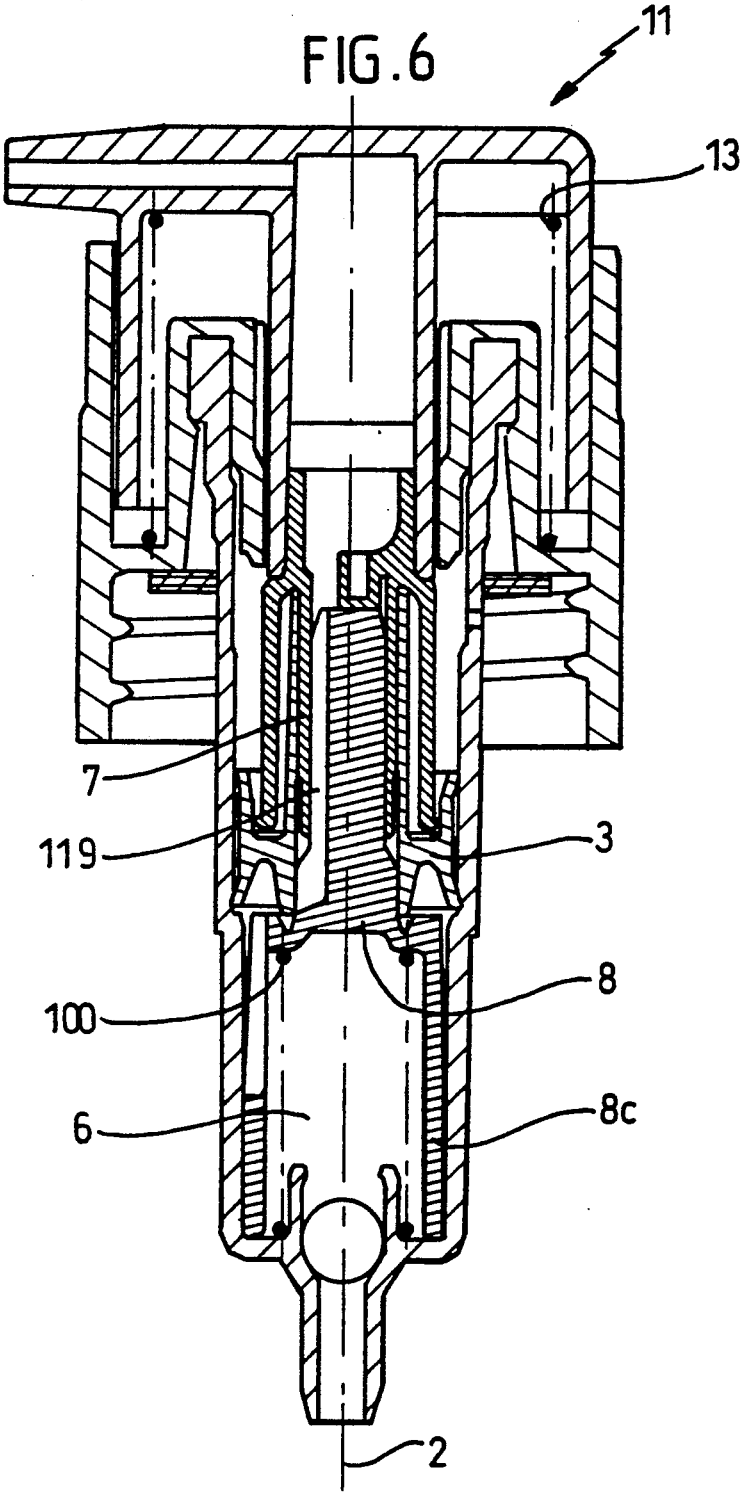
FIG. 6 is a view in axial cross-section of the pump from FIG. 5 shown in the operated position.

The second embodiment of the invention shown in FIGS. 5 and 6 consists in a metering pump whose various parts are substantially the same shape as in the pump of FIGS. 1 through 3. For this reason they will not be described in detail again. In the remainder of this description of the second embodiment of the invention the reference numbers of identical or similar parts of the pump will therefore be the same as those for the pump from FIGS. 1 through 3.

Unlike the pump from FIGS. 1 through 3, the sleeve 7 is not fastened to the inner core 8 but slides on said inner core 8. On the other hand, the axial tube 10 of the plunger 11 is force-fitted onto the tubular upper part 7*e* of the sleeve 7 with the result that the plunger 11 is fastened to the sleeve 7.

Also, the pump chamber 6 contains a spring 100 which bears on the reduced cross-section lower end 1*a* of the pump body and on the wider lower end 8*a* of the inner core 8 of the plunger-rod 7, 8 so as to urge said inner core 8 upwards.

Finally, the exterior flange 11*b* on the plunger 11 and the metal cup 14 crimped to the cap 9 are no longer needed as they are in the first embodiment.

When a user depresses the plunger 11 the sleeve 7 attached to the plunger 11 is moved downwardly until the interior relief 7*b* abuts the inner core 8. The inner core 8 is then moved down and the piston 3 is moved down because of friction between the sleeve 7 and said piston 3. This downward movement tends to decrease the volume of the pump chamber 6 and therefore increases the pressure in it which closes the inlet valve 15, 16, 17. The pump chamber 6 is then isolated. As the product contained in pump chamber 6 is incompressible the piston 3 initially remains immobile whereas the plunger-rod 7, 8 moves down in the pump body 1. This relative movement between the piston 3 and the plunger-rod 7, 8 lifts the lower end 4*a* of the tubular part of the piston off its seat 8*b* which establishes communication between the pump chamber 6 and the groove 8*f* of the core 8. When the upper end 4*b* of the tubular central part of the piston contacts the ring 7*a* of the sleeve 7 the piston 3 is in turn moved downwards.

As the piston 3 moves downwards in the pump chamber 6 the product contained in said pump chamber is therefore ejected from said pump chamber through the groove 8*f* of the inner core 8, the axial tube 10 and the outlet passage 12.

This downward movement ends when the skirt 8*c* of the inner core 8 contacts the reduced cross-section lower end 1*a* of the pump body 1, as shown in FIG. 6.

When the user releases the plunger 11 the inner core 8 of the plunger-rod 7, 8 is pushed upwards by the spring 100 whereas the piston 3 initially remains immobile because of the friction between said piston 3 and the pump body 1. The lower end 4*a* of the tubular part 4 of the piston is therefore applied to its seat 8*b* on the increased cross-section lower end 8*a* of the core 8, so isolating the pump chamber 6.

The piston 3 is then driven upward in its turn, which tends to increase the volume of the pump chamber 6 and so reduce the pressure in said pump chamber. Because of this reduction in pressure the inlet valve 15, 16, 17 opens and the product can enter the pump chamber 6 as the piston 3 and the plunger-rod 7, 8 rise due to the action of the spring 100.

When the top lip 5*b* of the piston 3 contacts the inner ring 9*a* of the cap 9 the movement of the piston ceases. The inner ring 8 of the plunger-rod 7, 8 is therefore also immobilized against the lower end 4*a* of the tubular central part 4 of the piston 3. The peripheral seat 8*b* of the core 8 is held against the lower end 4*a* by the spring 100: communication between the pump chamber 6 and the groove 8*f* of the core therefore remains cut off.

The sleeve 7 attached to the plunger 11 then continues to move upwards, due to the action of the spring 13, until the exterior flange 7*d* at the bottom of the exterior skirt 7*c* of the sleeve 7 contacts the inner ring 9*a* of the cap 9.

Because of the fluid-tight contact between the central tubular part 4 of the piston and the sleeve 7 and between the lower end 4*a* of said tubular central part 4 of the piston and the core 8, the plunger-rod 7, 8 and the piston 3 define an aspiration chamber 119 which communicates with the outside only through the axial tube 10 and the outlet passage 12: during the upward movement of the sleeve 7 relative to the inner core 8 and the piston 3 the volume of the aspiration chamber 119 increases which causes suction in the outlet passage 12. The product contained in the outlet passage 12 is therefore aspirated into the axial tube 10.

The increase in volume of the aspiration chamber 119 is preferably such that after this aspiration the level of the product in the axial tube 10 is below the outlet passage 12, so that the outlet passage 12 contains no more product.

Third embodiment

The pump shown in FIGS. 7 through 9 comprises a hollow cylindrical pump body 201 similar to that from FIGS. 1 through 3 having an axis of revolution 202. The pump body 201 has an open upper end 201*c* and a reduced cross-section lower end 201*a* which is extended downwardly by an inlet tube 201*b* which communicates with a reservoir of product to be dispensed (not shown) directly or via a down-tube (not shown).

The pump body 1 delimits a pump chamber 206 which normally contains the product to be dispensed. The inlet tube 201*b* is provided with an inlet valve which may, for example, comprise a ball 215 adapted to be applied in a fluid-tight manner to a valve seat 216 and shut off the inlet tube 201*b* when the pressure in the pump chamber 206 is increased. On the other hand, if the pressure in the pump chamber 206 is reduced the ball 215 is lifted off its seat 216 to open the inlet tube 201*b* although it is held near its seat 216 by arms 217 which extend from the reduced cross-section lower end 201*a* of the pump body. The inlet valve could be of any other known form without departing from the scope of the present invention.

As shown in FIG. 7, the pump body 201 may be snap-fastened into a cap 209 of which a central part 209*a* in which there is a central hole 209*b* caps the upper end 201*c* of the pump body. The cap 209 may, for example, be screwed onto the neck of the reservoir of product (not shown) and an annular gasket 230 may be disposed between the cap 209 and the neck of the reservoir. It goes without saying that the pump body 201 could be fixed by any other known means to the reservoir, for example by crimping a metal cup.

A piston 203 slides in the pump body 1. As shown in FIG. 9, the piston 203 is a body of revolution about the axis 202 and advantageously has at least one peripheral exterior sealing lip 205 and an interior lower tubular part 204. The piston 203 is extended upwardly by an upper annular part 203*a* to an upper end comprising an exterior peripheral sealing lip 203*b*.

The piston 203 slides with lost motion on a plunger-rod 207, 208 comprising a sleeve 207 force-fitted onto an inner core 208 so that said sleeve 207 and said inner core 208 are fastened together. The sleeve 207 comprises a ring 207*a* which defines a lower shoulder 207*f* and an upper shoulder 207*d*. The ring 207*a* is extended downwardly on the outside by a skirt 207*c* surrounding the sleeve 207. The upper annular part 203*a* of the piston slides inside the skirt 207*c*, the peripheral sealing lip 203*b* being in fluid-tight contact with the skirt 207*c*.

From the ring 207*a* the sleeve 207 is extended vertically upwards by an upper tubular part 207*e*. The sleeve 207 further comprises an interior relief 207*b* enabling precise relative positioning of the sleeve 207 and the inner core 208 when they are assembled together by inserting the inner core 208 into the sleeve 207 until it abuts the interior relief 207*b*.

The inner core 208 has an increased cross-section lower end 208*a* provided with a peripheral seat 208*b* forming a lower abutment for the lower tubular part 204 of the piston 203: the piston 203 is therefore trapped between an upper abutment formed by the lower shoulder 207*f* of the sleeve 207 and a lower abutment formed by the peripheral seat 208*b* of the inner core 208, whereby the piston 203 can slide with lost motion between these two abutments.

Above the peripheral seat 208*b* the inner core 208 comprises a cylindrical part 208*g* on which slides the lower tubular part 204 of the piston 203. An axial groove 208*f* is formed in the solid cylindrical part 208*g* of the core 208 starting a certain distance above the peripheral seat 108*b* and extends upwardly over all the length of the inner core 208 to discharge into the upper tubular part 207*c* of the sleeve 207. Thus when the tubular lower part 204 of the piston 3 slides on a solid cylindrical part 208*h* of the core between the peripheral seat 208*b* and the groove 208*f* said lower tubular part 204 isolates the pump chamber 206 from the groove 208*f*. On the other hand, when said lower tubular part 204 is above the solid cylindrical part 208*h* of the core the groove 208*f* communicates with the pump chamber 206.

The inner core 208 may further comprise a skirt 208*c* which extends the increased cross-section lower part 208*a* downwardly and slides in the pump body 1. The skirt 208*c* therefore contributes to guiding the plunger-rod 207, 208 in the pump body 1 and limits the downward movement of the plunger-rod 207, 208 by contacting the reduced cross-section lower end 201*a* of the pump body 1. The skirt 208*c* comprises one or more openings 208*d* enabling communication between the pump chamber 206 and the groove 208*c* of the core 208 when the lower tubular part 204 of the piston is above the part 208*h* of the core 208.

As shown in FIG. 7, an axial tube 210 which is a body of revolution about the axis 202 of a plunger 211 is force-fitted over the upper tubular end 207*e* of the sleeve in contact with the upper shoulder 207*d*. The axial tube 210 is extended by an outlet passage 212, a horizontal passage, for example, which discharges laterally from the plunger 211. The plunger 211 could be of any other known form and may incorporate a spray nozzle.

A spring 200 bears on the reduced cross-section lower end 201*a* and on the increased cross-section lower end 208*a* of the cord 208 and urges the plunger-rod 207, 208 upwards. Upward movement of the plunger-rod 207, 208 is limited by the skirt 207*c* of the sleeve 207 contacting the central part 209*a* of the cap 209. An annular gasket 231 is advantageously provided below the central part 209*a* of the cap 209, sandwiched at its outer perimeter between said central part 209*a* and the cap 209 and the upper end 201*c* of the pump body 201. The spring 200 presses the skirt 207*c* elastically against the gasket 231 to isolate the interior of the pump body 201 when the pump is not operated.

When a user depresses the plunger 211 the plunger-rod 207, 208 is pushed down and compresses the spring 200. This downward movement tends to move the piston 203 downwards and so decreases the volume of the chamber 206: this increases the pressure in the pump chamber 206 which closes the inlet valve 215, 216, 217. The pump chamber 206 is therefore initially isolated. As the product contained in the pump chamber 206 is incompressible the piston 203 initially remains immobile whereas the plunger-rod 207, 208 moves down in the pump body until the upper annular part 203*a* of the piston contacts the bottom shoulder 207*f* of the sleeve 207. During this sliding movement, as soon as the lower tubular part 204 of the piston 203 is above the part 208*h* of the core 208 the pump chamber 206 communicates with the groove 208*f* of the core 208 which itself communicates with the exterior through the upper tubular part 207*e* of the sleeve 207, the axial tube 210 and the outlet passage 212. The product contained in the pump chamber 206 therefore leaves the pump by this route while the piston 203 moves down in the pump body with the plunger-rod 207, 208 until the skirt 208*c* contacts the reduced cross-section lower end 201*a* of the pump body 201, as shown in FIG. 8.

When the user releases the pressure, the plunger-rod 207, 208 is pushed up by the spring 200. Because of the friction between the sealing lip 205 and the pump body 201, the piston 203 initially does not move. The core 208 therefore slides upwards relative to the lower tubular part 204 of the piston, which initially moves said lower tubular part 204 to the level of the part 208*h* of the core 208 where it interrupts communication between the pump chamber 206 and the groove 208*f* of the core 208. The part 208*h* of the core 208 then continues to slide upwards in the lower tubular part 204 of the piston, the effect of which is to increase the volume of an annular aspiration chamber 219 delimited by the sleeve 207, the core 208 and the piston 203 and which communicates only with the groove 208*f* because the exterior sealing lip 203*b* of the upper annular part 203 of the piston is in fluid-tight contact with the skirt 207*c* of the sleeve and the tubular lower part 204 of the piston is in fluid-tight contact with the solid part 208*h* of the core 208. The increased volume of the annular aspiration chamber 219 aspirates product in said chamber. The product contained in the outlet passage 212 is therefore aspirated towards said chamber 219.

The increase in the volume of the annular chamber 219 is preferably such that after this aspiration the level of the product in the axial tube 210 is below the outlet passage 212 so that said outlet passage 212 contains no more product.

When the tubular lower part 204 of the piston contacts the seat 208*b* of the core 208 the piston 203 is in turn moved upwards which decreases the pressure in the pump chamber 206. The inlet valve 215, 216, 217 therefore opens which enables product to enter the pump chamber 206 via the inlet tube 201*b* as the plunger-rod 207, 208 and the piston 203 rise in the pump body 201 until the skirt 207*c* of the sleeve contacts the gasket 231 under the central part 209*a* of the cap 209.

As in the first two embodiments of the invention, the pump body 201 may comprise an air inlet orifice 218, situated in this example above the rest position of the sealing lip 205 of the piston 203, to establish communication between the interior of the product reservoir and the atmosphere via the central hole 209*b* of the cap 209 when the skirt 207*c* of the sleeve is not in fluid-tight contact with the gasket 231. The air inlet orifice 218 therefore allows air to enter the product reservoir when the pump aspirates product in said reservoir while the piston 203 is rising.

FIG. 7*a* shows an alternative version of the pump from FIG. 7 in which the upper annular part 203*a* of the piston slides on the outside of the skirt 207*c* rather than the inside. This pump operates in the same way as the pump from FIG. 7 but has the additional advantage that if friction between the piston 203 and the pump body 201 is not sufficient to abut the lower tubular part 204 against its seat 208*b* this is effected by the abutment of the upper annular part 203*a* of the piston against the annular gasket 231 at the end of upward movement of the plunger-rod 207, 208, which pushes the piston 203 down against its seat 208*b*. The FIG. 7*a* pump is therefore very reliable and guarantees correct operation of the aspiration chamber 219. The FIG. 7*a* pump differs also from that of FIG. 7 in that the interior relief 207*b* of the sleeve is absent, being replaced by a shoulder 208*i* of the inner core providing an abutment for the sleeve 207 nested over said inner core 208.

FIG. 7*b* shows another version of the pump from FIGS. 1 through 9 with a very similar operating principle. The FIG. 7*b* pump is of similar construction to the pump from FIGS. 7 through 9 and this construction will not be described in detail again, parts identical or similar to the pump from FIGS. 7 through 9 having the same reference numbers.

As previously, the FIG. 7*b* pump comprises a pump body 201 in which slides a piston 203 similar to that from FIGS. 7 through 9. In the FIG. 7*b* example the pump body 1 is mounted on the neck of a reservoir by means of a conventional crimped metal cup 246.

The piston 203 slides with lost motion on a plunger-rod 207, 208 formed by an inner core 208 force-fitted into a sleeve 207 which projects from the pump body and receives an actuating plunger 211 which in this example incorporates a spray nozzle 211*a*.

As in the embodiment of FIGS. 7 through 9, the sleeve 207 comprises a lower exterior skirt 207*c* in which an upper annular part 203*a* of the piston slides in a fluid-tight manner, defining an annular aspiration chamber 219 disposed around the core 208 of the plunger-rod. The sleeve 207 further comprises an exterior flange 207*g* on which bears a spring 204 mounted between said flange 207*g* and the piston 203. The spring operates in compression.

Unlike FIGS. 7 through 9, the core 208 does not comprise an axial groove through which the product is dispensed but instead a central outlet passage 241 which discharges laterally at the lower end through one or more orifices 242 formed above the part 208*h* of the core on which the lower tubular part 204 of the piston can slide in a fluid-tight manner.

Above said part 208*h*, the piston 203 is not in fluid-tight contact with the core 208 with the result that the aspiration chamber 219 communicates permanently with the orifice 242 and the outlet passage 241.

The operation of the pump from FIG. 7*b* differs from that of the pump from FIGS. 7 through 9 only in the effect of the spring 240, which provides a prestressing effect. When the pump is actuated, the piston moves relative to the sleeve 208 only when the pressure in the pump chamber has reached a particular value, sufficient to overcome the action of said spring 240. The spring 240 also returns the piston 203 to a fluid-tight position, that is to say a position in which the tubular lower part 204 is in fluid-tight contact with the part 208*h* of the core, immediately the pressure falls in the pump chamber.

Unlike the previous embodiments, the pump from FIG. 7*b* is provided with a nozzle for spraying a liquid product and operates with precompression. This means that the product is expelled only if a predetermined pressure is exerted on the plunger 11. There is a difference as compared with ordinary precompression pumps, however: after a precompression pump is actuated, there remains some liquid in the chamber 250 to the rear of the spray nozzle 251. On the next actuation this droplet of liquid is generally expelled without being sprayed, so that spraying begins badly. With the reaspiration obtained by increasing the volume of the chamber 219, the volume of the chamber 250 is emptied. Under these conditions, at the time of actuation the liquid will arrive in this chamber with pressure and kinetic energy and will be divided from the outset on striking against the surround of the nozzle 251. Spraying is immediate, with no projection of any droplet at the start of spraying.

Fourth embodiment

The pump shown in FIGS. 10 through 12 comprises a hollow cylindrical pump body 301 having an axis of revolution 302. The pump body 301 has an open upper end 301*c* and a reduced cross-section lower end 301*e* extending between an interior shoulder 301*d* on the pump body and a reduced cross-section lower end 301*a* extended downwardly by an inlet tube 301*b* which communicates with a reservoir of product to be dispensed (not shown) directly or via a down-tube 333.

The pump body 301 delimits a pump chamber 306 which normally contains product to be dispensed and which communicates with the inlet tube 301*b* through an inlet valve which may comprise, for example, a gasket 315 adapted to be applied in a fluid-tight manner to a seat 316 to close off the inlet tube 301*b* when the pressure in the pump chamber 306 is increased. On the other hand, if the pressure in the pump chamber 306 is reduced, the gasket 315 lifts off its seal 316 to open the inlet tube 301*b*, although it is held near its seat 316 by a valve-holder 317 enabling communication between the down-tube 333 and the pump chamber 306. The inlet valve could be of any other known form without departing from the scope of the present invention.

As shown in FIG. 10, the pump body 301 may be crimped by means of a metal cup 309 to the neck of the reservoir. It goes without saying that the pump body 301 could be fixed to the reservoir by any other known means.

A hollow piston 303 which is a body of revolution about the axis 302 slides in the pump body 301. As shown in FIG. 11 the piston 303 comprises an outer ring 305 of which at least one peripheral part is in fluid-tight contact with the pump body 301 and a cylindrical tubular interior part 304 with a reduced cross-section part 404*a* at the lower end. The exterior ring 305 and the tubular interior part 304 of the piston 303 are molded in one piece and joined together by an annular part 303*a*.

A substantially cylindrical plunger-rod 307 centred on the axis 302 and whose outside diameter is equal to the inside diameter of the interior tubular part 304 of the piston slides in said interior tubular part 304. The plunger-rod 307 has a reduced cross-section lower part 307*d* whose outside diameter is equal to the inside diameter of the reduced cross-section lower part 304*a* of said tubular part 304 of the piston. The interior tubular part 304 of the piston and the plunger-rod 307 therefore delimit an annular chamber 319 referred to hereinafter as the aspiration chamber whose volume is maximum when the plunger-rod 307 is in a raised position relative to the piston 303, as shown in FIG. 11, and whose volume decreases when said plunger-rod 307 is depressed relative to said piston 303, as shown in FIG. 12.

Referring to FIG. 11, a blind axial bore 307*a* in the plunger-rod 307 discharges laterally through at least one orifice 307*b* in the reduced cross-section lower part 307*d* of the plunger-rod. A groove 307*c* parallel to the axis 302 extends upwardly on the outside of the reduced cross-section lower part 307*d* from the lateral orifice 307*b*.

Finally, the plunger-rod 307 has a flange 307*e*. A spring 334 is disposed between the flange 307*e* and the annular part 303*a* of the piston 303.

An annular member 308 is disposed under the smaller cross-section lower part 304*a* of the interior tubular part 304 of the piston and urged upwards by a spring 300 whose stiffness is less than that of the spring 334 which bears on the valve-holder 317 as shown in FIG. 10. The annular member 308 is therefore pressed against the reduced cross-section lower part 304*a* and urges said reduced cross-section lower part 304*a* elastically and in a fluid-tight manner against the reduced cross-section lower part 307*d*, also pushing the piston 303 upwards. The upward travel of the piston 303 is limited by the crimped metal cup 309. Likewise, the plunger-rod 307 is urged upwards by the spring 334 and its upward travel is limited by abutment of the flange 307*e* against the cup 309. An annular gasket 331 is advantageously disposed between the upper end 301*c* of the pump body and the cup 309. In the unoperated condition, that is to say where no external action is applied to the plunger-rod 307 by a user, the flange 307*e* of the plunger-rod is therefore applied in a fluid-tight manner to the gasket 331 by the action of the spring 334. Likewise, the exterior ring 305 of the piston abuts the gasket 331 due to the action of the spring 300.

As shown in FIG. 11, in the unoperated position the orifice 307*b* of the plunger-rod 307 discharges laterally inside the aspiration chamber 319: it is therefore isolated from the pump chamber 306 by the fluid-tight contact between the reduced cross-section lower part 307*d* of the plunger-rod and the reduced cross-section lower part 304*a* of the interior tubular part 304 of the piston.

When a user depresses the plunger-rod 307, usually through the intermediary of a plunger (not shown) which can be of any known form, for example of the form shown in FIG. 5 for the second embodiment of the invention, it causes said plunger-rod 307 to move downwardly in the pump chamber 306 which compresses the spring 334 which in turn urges the piston 303 downwards. This tends to decrease the volume of the pump chamber 306 and therefore to increase the pressure in it which closes the inlet valve 315, 316, 317. The pump chamber 306 is then isolated. As the product that it contains is incompressible, the piston 303 cannot move downwards in the pump chamber: only the plunger-rod 307 moves downward, therefore, compressing the spring 334. During this relative movement of the plunger-rod 307 and the piston 303 the volume of the aspiration chamber 319 decreases. However, there is no increase in pressure in said aspiration chamber 319 such as to impede the downward movement of the plunger-rod 307 relative to the piston 303: the chamber 319 is never isolated because in the unoperated condition it communicates with the exterior through the orifice 307*b*, as shown in FIG. 11, and then communicates with the exterior through the groove 307*c* and the orifice 307*b*, as long as the reduced cross-section lower end 304*a* isolates the orifice 307*b* from the pump chamber 306, and then communicates with the pump chamber 306 through the groove 307*c* when the reduced cross-section lower end 304*a* is located above the orifice 307*b*, as shown in FIG. 12. As soon as the orifice 307*b* has moved below the reduced cross-section lower end 304*a* of the tubular part 304 of the piston 303 as shown in FIG. 12 the pressurized product in the pump chamber exits to the exterior through the orifice 307*b* and the axial passage 307*a* of the plunger-rod. The piston 303 then moves downwards in the pump body 301 as the volume of product contained in the pump chamber 306 decreases, compressing the spring 300, until the annular member 308 abuts the shoulder 301*d* at which point the downward movement of the plunger-rod 307 and the piston 303 ceases.

When the user releases the plunger-rod 307 the stiffer spring 334 first resumes its initial shape by pushing the plunger-rod 307 upwards relative to the piston 303. During this movement the volume of the annular aspiration chamber 319 increases. When the plunger-rod 307 has risen sufficiently for the smaller cross-section lower end 304*a* of the interior tubular part of the piston to isolate the orifice 307*b* from the chamber 306, this increase in volume produces suction in the axial passage 307*a* via the orifice 307*b* and, possibly during part of the movement, the groove 307*c*. Some of the product contained in the axial passage 307*a* and in the outlet passage of the plunger (12 in FIG. 5) is therefore aspirated towards the annular chamber 319. The volume of product aspirated in this way is such that said outlet passage 12 does not contain any more product after such aspiration.

After the spring 334 has expanded the spring 300 expands in turn, pushing up the piston 303 and the annular member 308 This movement reduces the pressure in the pump chamber 306 and therefore opens the inlet valve 315, 316, 317, enabling the product contained in the reservoir to enter the pump chamber 306 and the piston 303 rises, until it reaches the unoperated position.

In the embodiment shown in FIG. 10 the pump body 1 has an air inlet orifice 318 near the upper end 301*c* of said pump body and said upper end 301*c* of the pump body has an increased inside diameter so that the exterior ring 305 of the piston 303 is not in fluid-tight contact with the pump body above and at the level of the air inlet orifice 318 Also, when the plunger-rod is depressed, the flange 307*e* is no longer in contact with the gasket 331 with the result that air can pass between the plunger-rod 307 and the gasket 331. While the piston 303 is rising, when product is aspirated from the reservoir into the pump chamber 306, a volume of air equal to the volume of product aspirated into the pump chamber can therefore enter the reservoir through the air inlet orifice 318.

Nevertheless, the air inlet orifice 318 could be dispensed with without departing from the scope of the present invention.

In the foregoing description, reference has been made to a pump or a valve in a vertical position, with the plunger directed upwards, which is the usual position of such devices: of course, this does not limit their use to this particular position.

We claim:

1. A pump for dispensing or spraying a fluid product, comprising: a pump body (201) delimiting a pump chamber (206) in which slides a piston (203), said piston being able to compress said pump chamber to expel said product therefrom, said pump comprising a hollow plunger-rod (207, 208) having an outlet passage (**208*f*), said plunger-rod being movable between a rest position and an end of stroke position, and said plunger-rod being coupled to the piston to actuate said piston and to enable escape of the product when said plunger-rod is displaced from its rest position, said pump having return means for returning said plunger rod towards it rest position, said pump further comprising an aspiration chamber (219**) which communicates with said outlet passage and which is reduced in volume when the plunger-rod is displaced from its rest position and increased in volume when the plunger-rod returns to its rest position, wherein said aspiration chamber is delimited by the piston and the plunger-rod, and the volume of said aspiration chamber is varied by relative sliding movement between the plunger-rod and the piston.

2. A pump according to claim 1, wherein the plunger-rod comprises a ring (**207*a*) extended towards the pump chamber by a skirt (207*c*) inside which slides an upper annular part (203*a*) of the piston in fluid-tight contact with said skirt, said skirt having a first inside diameter, and wherein said plunger-rod further comprises a solid cylindrical part (208*h*) on which a lower tubular part (204**) of the piston can slide to cut off communication between the pump chamber and the outlet passage, said pump chamber communicating with said outlet passage when said lower tubular part of the piston is above said solid cylindrical part of the plunger-rod, said solid cylindrical part having a second outside diameter, and said first inside diameter being greater than said second outside diameter.

3. A pump according to claim 2, wherein said return means comprises a return spring (200) disposed in the pump chamber which urges the plunger-rod towards an exterior, dispensing outlet of the pump.

4. A pump according to claim 1, further comprising a plunger (211) having an outlet passage connected to said outlet passage of said plunger-rod, said plunger outlet passage having a horizontal outlet end (212), the increase in volume of said aspiration chamber being sufficient to empty product from at least said horizontal outlet end, and product remaining in said plunger outlet passage after said increase in volume having a level below said horizontal outlet end.

5. A pump according to claim 2, further comprising a plunger (211) having an outlet passage connected to said outlet passage of said plunger-rod, said plunger outlet passage having a horizontal outlet end (212), the increase in volume of said aspiration chamber being sufficient to empty product from at least said horizontal outlet end, and product remaining in said plunger outlet passage after said increase in volume having a level below said horizontal outlet end.

6. A pump according to claim 3 wherein said return means includes a precompression spring mounted between the plunger-rod and the piston and which urges the piston towards a position in which said lower tubular part of the piston slides on said solid cylindrical part of the plunger-rod.

7. A pump according to claim 1 wherein the plunger-rod comprises a reduced cross-section lower part having a lateral orifice (**307*b*) communicating with the outlet passage and an interior tubular part sliding in fluid-tight contact with the plunger-rod, said interior tubular part being extended by a reduced cross-section lower end (304*a***) sliding in fluid-tight contact with the reduced cross-section lower part of the plunger-rod, said aspiration chamber being delimited by the plunger-rod, the reduced cross-section lower part thereof, the interior part of the piston, and the reduced cross-section lower end thereof.

8. A pump according to claim 7 wherein the reduced cross-section lower part of the plunger-rod comprises at least one groove (**307*c***) extending in an axial direction from the lateral orifice away from the pump chamber.

9. A pump according to claim 7 wherein said return means comprises a first spring disposed in the pump chamber which urges the piston towards an exterior of the pump and a second spring mounted between the plunger-rod and the piston which urges the plunger-rod away from the piston towards the exterior of the pump.

10. A pump according to claim 8 wherein said return means comprises a first spring disposed in the pump chamber which urges the piston towards an exterior of the pump and a second spring mounted between the plunger-rod and the piston which urges the plunger-rod away from the piston towards the exterior of the pump.

11. A pump according to claim 1 wherein an upper annular part of the piston slides outside of and in fluid-tight contact with a complementary part (**207*c***) of the plunger-rod, and wherein said plunger-rod further comprises a solid cylindrical part on which a lower tubular part of the piston can slide to interrupt communication between the pump chamber and the outlet passage, said pump chamber communicating with said outlet passage when said lower tubular part of said piston is above said solid cylindrical part of the plunger-rod.

12. A pump according to claim 11 wherein said return means comprises a return spring disposed in the pump chamber which urges the plunger-rod towards an exterior, dispensing outlet of the pump.

* * * * *